United States Patent [19]

Makino et al.

[11] 4,214,717

[45] Jul. 29, 1980

[54] FALSE REELING PREVENTING APPARATUS FOR TRAVERSE THREAD REELING MACHINES

[75] Inventors: Shozaburo Makino, Kawasaki; Seiji Otobe, Yono, both of Japan

[73] Assignee: Nippon Seren Co. Ltd., Kawasaki, Japan

[21] Appl. No.: 39,552

[22] Filed: May 16, 1979

Related U.S. Application Data

[63] Continuation of Ser. No. 694,566, Jun. 10, 1976, abandoned.

[30] Foreign Application Priority Data

Jun. 10, 1975 [JP] Japan ..... 50-69115

[51] Int. Cl.[2] ..... B65H 63/00

[52] U.S. Cl. ..... 242/36

[58] Field of Search ..... 242/36, 37 R, 39, 28, 242/49; 250/548, 559, 561; 28/222, 226, 227; 83/365; 57/264, 78, 79, 80, 81

[56] References Cited

U.S. PATENT DOCUMENTS

| | | | |
|---|---|---|---|
| 3,592,400 | 7/1971 | Gith | 242/36 |
| 3,676,769 | 7/1972 | Loepfe | 242/36 UX |
| 3,734,422 | 5/1973 | Loepfe | 242/36 |
| 3,756,524 | 9/1973 | Felix | 242/36 |
| 3,774,860 | 11/1973 | Loepfe | 242/36 |
| 3,801,031 | 4/1974 | Kamp et al. | 242/36 |

*Primary Examiner*—Stanley N. Gilreath

*Attorney, Agent, or Firm*—Laurence R. Brown

[57] ABSTRACT

A traverse thread reeling machine wherein a thread reeling bobbin is mounted on a driven drum having a wave-shaped groove fitting a thread on the outer periphery so that the thread may be reciprocated at a predetermined period by the wave-shaped groove on the drum, light sources and photoelectric elements are provided as opposed to each other on both sides of the thread reciprocating plane so that, when the photoelectric elements have stopped sending out pulse outputs, a signal may be sent to a cutter or a drum driver to cut the thread or to stop the drum to thereby prevent a false reeling.

4 Claims, 3 Drawing Figures

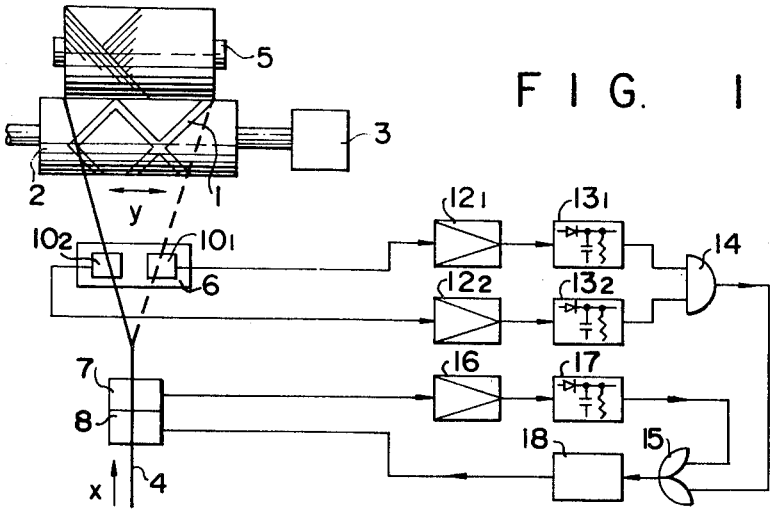
FIG. 1
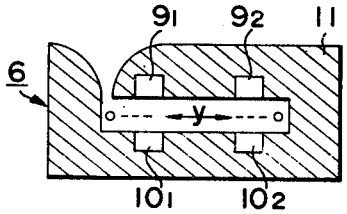
FIG. 2
FIG. 3
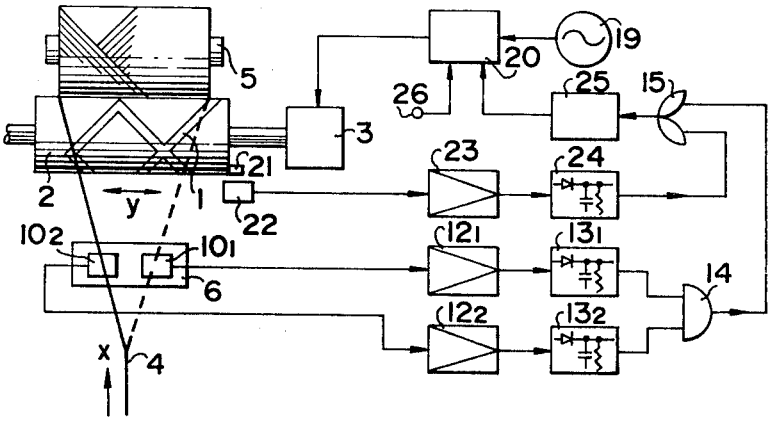

FALSE REELING PREVENTING APPARATUS FOR TRAVERSE THREAD REELING MACHINES

This is a continuation of application Ser. No. 694,566, filed June 10, 1976, now abandoned.

This invention relates to a false reeling preventing apparatus for traverse thread reeling machines.

Generally, in a traverse thread reeling machine in a spinning plant, a drum provided with a wave-shaped thread guiding groove is arranged in front of a bobbin so as to axially reciprocate a thread. In such traverse thread reeling machine, once the thread comes out of the groove to disturb the traverse due to a flaw on the drum, thread tension fluctuation or static electricity, a false reeling will then proceed like an avalanche and, in some case, the thread will wind on the grooved drum to make a so-called drum trap. Therefore, in case the traverse has stopped, it will be necessary to immediately detect it and stop the reeling operation. However, conventionally, merely a sensing bar is arranged near the drum and the drum trap is prevented by a mechanical means or such means as of preventing the generation of static electricity by the air-conditioning of the plant is only taken. Therefore, there have been defects that many false products will be made, that the production efficiency will be reduced and that, in some case, the machine will be damaged.

An object of the present invention is to provide a machine wherein a false reeling is very quickly and positively prevented by electronically detecting any abnormal traverse and stopping reeling the thread.

FIG. 1 is a view showing the formation of an embodiment of the present invention.

FIG. 2 is a view showing the structure of a part in FIG. 1.

FIG. 3 is a view showing the formation of another embodiment of the present invention.

In FIG. 1 showing the formation of an embodiment of the present invention, a drum 2 provided with a wave-shaped groove 1 is rotated always at a constant velocity by an electric motor 3. As a bobbin 5 on which a thread 4 is reeled is rotated as mounted on the above mentioned drum 2 and the thread 4 is fitted in the groove 1, the thread 4 will be pulled by the bobbin 5 to run as indicated by the arrow x and to reciprocate at a predetermined period as indicated by the arrow y. Therefore, the thread 4 will be traverse reeled on the bobbin 5. In such traverse thread reeling machine, a traverse detector 6 is provided in the part through which the thread 4 reciprocates and a running detector 7 and a cutter 8 are provided in the running course.

In FIG. 2 showing the formation of the traverse detector 6, the thread 4 runs at right angles with the paper plane and reciprocates as indicated by the arrow y in the paper plane at right angles with the running direction. Such light sources $9_1$ and $9_2$ as luminous diodes and such photoelectric elements $10_1$ and $10_2$ as phototransistors are opposed to each other on both sides of the reciprocating plane and a plurality of such sets are fitted to the inside surfaces of a holding frame 11. Therefore, when the thread 4 reciprocates as indicated by the arrow y, whenever the thread traverses in front of the photoelectric elements $10_1$ and $10_2$, they will send out pulse outputs. The running detector 7 is also provided with the same light sources and photoelectric elements as opposed to each other on both sides of the thread 4 so that, when the thread 4 runs, a noise output of a high frequency may be sent out of each photoelectric element by its fine irregular fibrils or the like. Further, the cutter 8 is formed integrally with the above mentioned detector so that, when a large electric current is momentarily made to flow through an electromagnet, a movable element driven by the electromagnet may impact and out the thread.

The outputs of the photoelectric elements $10_1$ and $10_2$ in such traverse detector 6 as is described above are applied to alternating current amplifiers $12_1$ and $12_2$ so as to be amplified and are applied to rectifiers $13_1$ and $13_2$ in each of which a smoothing condenser is connected through a diode with the input end and is connected with a proper leakage resistance. Therefore, when the photoelectric elements $10_1$ and $10_2$ send out output pulses, direct current voltages will be sent out of the output ends and, when the pulses vanish, the above mentioned voltages will also vanish with proper time constants. As these direct current outputs are applied to a logic product circuit 14, when the rectifiers $13_1$ and $13_2$ both send out output voltages, an output signal will be sent out of the logic product circuit 14 and will be applied as one input to an exclusive logic sum circuit 15.

Further, when the thread 4 runs, a noise output of a high frequency will be sent out of the running detector 7 as described above and will be applied to the same rectifier 17 as the above mentioned rectifiers through an amplifier 16. Therefore, when the thread 4 begins to run, an output signal of a direct current voltage will be sent out of the rectifier 17 and will be applied as the other input to the above mentioned exclusive logic sum circuit 15 and a switch circuit 18 for momentarily applying a large electric current to the electromagnet of the above mentioned cutter 8 will be controlled by the output signal of this circuit 15.

Therefore, when the thread 4 is reeled to begin to run, a direct current voltage, that is, a signal "1" will be applied to the exclusive logic sum circuit 15 from the rectifier 17. When the thread 4 reciprocates as indicated by the arrow y so as to be normally reeled, all the plurality of photoelectric elements $10_1$ and $10_2$ in the traverse detector 6 will send out pulse outputs of predetermined periods, therefore both inputs of the logic product circuit 14 will become the signal "1" and its output signal "1" will be applied to the exclusive logic sum circuit 15. Therefore, the output signal of the above mentioned logic sum circuit 15 will be "0" to keep the switch circuit 18 inoperative. However, when the traverse stops due to such cause as is described above, at least one input signal applied to the logic product circuit 14 will become "0", therefore, the output signal of the exclusive logic sum circuit 15 will become "1", the switch circuit 18 will operate and an electric current will be applied to the cutter 8 to cut the thread 4. Therefore, the reeling of the thread will stop.

By the way, as the traverse detector 6 is provided with a plurality of sets of the light sources and photoelectric elements, even in case the thread 4 reciprocates abnormally in the range opposed to a part of them, it will be able to be positively detected. Further, when the reeling of the thread stops as described in the above, the output of the running detector 7 will also vanish, therefore the output signal of the exclusive logic sum circuit 15 will return to "0" and the switch circuit 18 and cutter 8 will recover.

In FIG. 3 showing another embodiment of the present invention, a switch circuit 20 is provided between a commercial alternating current source 19 and an electric motor 3, a permanent magnet 21 is attached to the edge of a drum 2 and a coil 22 is set as opposed to the track of the magnet. The output of this coil 22 is amplified with an amplifier 23 and is applied to a rectifer 24 and its output signal is applied to an exclusive logic sum circuit 15. Further, the output signal of the above mentioned logic sum circuit 15 is applied to a controller 25 and the switch circuit 20 is opened by the output of this controller. The switch circuit 20 is closed by the signal of a terminal 26. The other formation is the same as in the apparatus of FIG. 1.

In the apparatus of the above mentioned FIG. 3, when a signal is applied to the terminal 26, the switch circuit 20 will be closed, the motor 3 will start, the drum 2 will rotate and therefore the reeling of the thread 4 will be started. At the same time, the magnet 21 will rotate. Therefore, whenever this magnet passes by the side of the coil 22, a pulse output will be sent out of said coil. Said pulse will be amplified by the amplifier 23 and will be applied to the rectifier 24 and therefore said rectifer will send out a direct curruent voltage, that is, a signal "1". However, if a normal reeling is carried out in this stage, the signal "1" will be sent out of the logic product circuit 14 as described above. Therefore, the output signal of the exclusive logic sum circuit 15 will become "0" and the controller 25 will send out no signal. However, if the reciprocation of the thread 4 becomes abnormal, the output signal of the logic product circuit 14 will become "0", the output signal of the exclusive logic sum circuit 15 will become "1" and therefore the controller 25 will send out a signal to open the switch circuit 20. Therefore, the thread 4 reeling operation will stop, at the same time, the output pulse of the coil 22 will also vanish, therefore the output signal of the logic sum circuit 15 will return to "0" and the output signal of the controller 25 will also vainish. Therefore, by correcting the abnormal state of the thread 4 and applying a signal to the terminal 26, the reeling can be resumed.

As explained on the above embodiments, in the present invention, as any abnormal operation of a thread is electronically detected, the responsiveness will be high and the operation will be positive and, as there is no part in contact with the thread, the thread will not be likely to be damaged. Further, there are such excellent effects that the apparatus is small in the shape and is so easy to fit that there is no need of modifying the structure of the thread reeling machine in fitting it.

What is claimed is:

1. In a reeling machine in which a thread is traversed as it is reeled on a bobbin, the improvement comprising in combination, two electronic sensors positioned to intercept without contact with the thread the traverse of the thread in two spaced traverse positions representative of a full traverse span across the bobbin and to produce a pulse from each sensor upon traverse of the thread across the full traverse span, rectifier means for each sensor providing a separate d-c signal having a time constant maintaining a d-c signal when the thread is traversed at its normal traverse rate, a single logic circuit combining the two d-c signals to produce an output signal whenever either of the separate d-c signals are missing because of an incomplete thread traverse, and alarm means for preventing the thread from being reeled onto said bobbin responsive to the output signal from the single logic circuit.

2. The improvement defined in claim 1 including thread travel detection means providing a direct current output signal indicative of moving thread signal and a further logic circuit combining the two output signals to operate said alarm means whenever one of the output signals is missing.

3. The improvement defined in claim 1 wherein the alarm means comprises a cutter cutting the thread.

4. The improvement defined in claim 1 wherein the alarm means comprises means preventing the bobbin from turning.

* * * * *